US005712244A

United States Patent [19]

Addison et al.

[11] Patent Number: 5,712,244

[45] Date of Patent: *Jan. 27, 1998

[54] RINSE AID COMPOSITIONS COMPRISING NON-NITROGEN-CONTAINING ORGANS DIPHOSPHONIC ACID, SALT OR COMPLEX THEREOF

[75] Inventors: Michael Crombie Addison; Lynda Anne Jones; Rhona Alexandra Knox, all of Newcastle upon Tyne, England

[73] Assignee: Proctor & Gamble Company, Cincinnati, Ohio

[ * ] Notice: The term of this patent shall not extend beyond the expiration date of Pat. No. 5,545,352.

[21] Appl. No.: 704,211

[22] Filed: Aug. 28, 1996

Related U.S. Application Data

[63] Continuation of Ser. No. 350,352, Dec. 6, 1994, abandoned.

[30] Foreign Application Priority Data

Dec. 23, 1993 [GB] United Kingdom ..... 9326235

[51] Int. Cl.[6] ..... C11D 3/36; C11D 1/66; C11D 3/37

[52] U.S. Cl. ..... 510/514; 510/421; 510/434; 510/436; 510/469; 510/476; 510/477

[58] Field of Search ..... 510/514, 222, 510/223, 228, 229, 230, 434, 436, 469, 476, 477, 421

[56] References Cited

U.S. PATENT DOCUMENTS

| | | | |
|---|---|---|---|
| 3,687,858 | 8/1972 | Geisler et al. | 252/156 |
| 3,784,469 | 1/1974 | Krueger et al. | 252/180 |
| 3,791,978 | 2/1974 | Krueger et al. | 252/180 |
| 4,704,212 | 11/1987 | Schindler et al. | 252/8.8 |
| 4,810,405 | 3/1989 | Waller et al. | 252/81 |
| 4,846,993 | 7/1989 | Lentsch et al. | 252/95 |
| 4,935,065 | 6/1990 | Bull | 134/22.13 |
| 5,118,436 | 6/1992 | Aoyagi et al. | 252/186.42 |
| 5,281,351 | 1/1994 | Romeo et al. | 252/99 |
| 5,382,295 | 1/1995 | Aoki et al. | 134/2 |
| 5,545,346 | 8/1996 | MacBeath et al. | 510/514 |
| 5,545,352 | 8/1996 | Pike | 510/514 |

FOREIGN PATENT DOCUMENTS

| | | |
|---|---|---|
| 0 364 067 | 4/1990 | European Pat. Off. . |
| 4-332800 | 11/1992 | Japan . |
| 4332800 | 11/1992 | Japan . |
| 673 033 A5 | 1/1990 | Switzerland . |
| 2203163 | 10/1988 | United Kingdom . |
| 2227021 | 7/1990 | United Kingdom . |

OTHER PUBLICATIONS

Chemical Abstract Accession No. 118:215376, for JP 4–332800, Nov. 19, 1992.

Derwent Abstract Accession No. 93–004727, for JP 4–332800, Nov. 19, 1992.

*Primary Examiner*—Ardith Hertzog
*Attorney, Agent, or Firm*—K. K. Patel; K. W. Zerby; J. C. Rasser

[57] ABSTRACT

There is provided a rinse aid composition containing an organo diphosphonic acid or its salts or complexes. The pH of said composition as a 1% solution in distilled water at 20° C. is preferably less than 7.

26 Claims, No Drawings

RINSE AID COMPOSITIONS COMPRISING NON-NITROGEN-CONTAINING ORGANS DIPHOSPHONIC ACID, SALT OR COMPLEX THEREOF

This is a continuation of application Ser. No. 08/350,352, filed on Dec. 6, 1994, now abandoned.

TECHNICAL FIELD

The present invention relates to rinsing (rinse aid) compositions, particularly acidic rinsing compositions containing an organo diphosphonic acid crystal growth inhibitor component.

BACKGROUND OF THE INVENTION

Rinse aid compositions designed for use in automatic dishwasher machines are well known. These compositions are added during the rinsing cycle of the machine, separately from the detergent composition employed in the main wash cycle(s). The ability to enhance rinsing, and in particular the ability to prevent spot and film formation are common measures of rinse aid performance.

Rinse aid compositions typically contain components such as nonionic surfactants and/or hydrotropes which aid the wetting of the items in the rinse, thereby improving the efficacy of the rinsing process. These surfactants, and rinse aid compositions in general, are not designed for the achievement of a primary soil removal purpose.

The general problem of the formation of deposits as spots and films on the articles in the wash/rinse, and on the dishwasher machine parts is well known in the art.

Whilst the general problem of deposit formation is known, a full understanding of the many facets of the problem is however still an active area of research.

A range of deposit types can be encountered. The redeposition of soils or the breakdown products thereof, which have previously been removed from the soiled tableware in the washload, provides one deposit type. Insoluble salts such as calcium carbonate, calcium fatty acid salts (lime soaps), or certain silicate salts are other common deposit types. Composite deposit types are also common. Indeed, once an initial minor deposit forms it can act as a "seeding centre" for the formation of a larger, possibly composite, deposit structure.

Deposit formation can occur on a range of commonly encountered substrate surfaces including plastic, glass, metal and china surfaces. Certain deposit types however, show a greater propensity to deposit on certain substrates. For example, lime soap deposit formation tends to be a particular problem on plastic substrates.

The formation of insoluble carbonate, especially calcium carbonate, deposits is a particular problem in the machine dishwashing art. There is a general appreciation in the art, as represented for example by EP-A-364,067 in the name of Clorox, CH-A-673,033 in the name of Cosmina, and EP-A-551,670 in the name of Unilever, that calcium carbonate deposit formation is a particular problem when non-phosphate containing detergent formulations are employed. In general, this can be explained by the slightly inferior builder capacity of the typically employed non-phosphate builder systems in comparison to phosphate builder formulations. The problem of calcium carbonate deposit formation is understood to be especially apparent when these formulations contain a carbonate builder component, as for example is essential to the compositions taught by EP-A-364,067.

The Applicants have now found that the problem of $CaCO_3$ deposit formation can exist even in the absence of a carbonate builder component in the machine dishwashing detergent formulation, and especially when that formulation contains no phosphate builder components. It has also been established that the problem is most apparent when highly alkaline formulations, such as those of pH of 9.8 and above, are employed.

The naturally sourced, inlet water to the dishwasher machine can be a sufficient source of $Ca^{2+}$ and $Mg^{2+}$ ions and $CO_3^{2-}/HCO_3^-$ ions to make deposit formation a problem. Whilst the salt softening system, through which the inlet water will pass prior to entry into the main cavity of the dishwasher machine, can be efficient at removing the naturally present $Ca^{2+}$ and $Mg^{2+}$ ions it is inefficient at removing the $CO_3^{2-}/HCO_3^-$ ions which therefore enter into the wash/rinse solution.

The Applicants have now established that both the levels of $Ca^{2+}/Mg^{2+}$ hardness ions and the levels of $CO_3^{2-}/HCO_3^-$ ions in the wash/rinse water of the dishwasher machine are factors controlling calcium carbonate deposit formation. Critical levels of both components must be exceeded for deposit formation to occur. These critical levels are to an extent interdependent. Thus, even in wash/rinse solutions containing high levels of one component, deposit formation will not occur in the absence of the critical level of the other component.

The Applicants have further established that the formation of calcium carbonate deposits occurs most noticeably in the rinse cycle of the dishwasher machine. Deposit build up is most apparent on the heater element of the dishwasher machine.

The Applicants have found that the problem of calcium carbonate deposit formation may be effectively ameliorated by the inclusion of an organo diphosphonic acid crystal growth inhibitor component into a rinse aid formulation. Said rinse aid formulation is of particular utility when used in combination with non-phosphate containing detergent formulations which, as previously mentioned, tend to be more susceptible to the problem of calcium carbonate deposit formation.

The Applicants have also found that carboxylates and polycarboxylates, particularly citrates, are especially useful components of the compositions of the invention because of their magnesium binding capacity which tends to prevent the formation of insoluble magnesium salts, such as magnesium silicate on the articles in the wash. Such polycarboxylates also provide calcium binding capacity to the compositions, thus contributing further to the prevention of the formation of calcium salt deposits.

The Applicants have also found that the more effective control of calcium carbonate deposition can also lead to benefits in the prevention of the formation of other deposit types, particularly lime soap deposits and silicate deposits.

Lime soap deposits are most commonly encountered when the washload contains fatty soils, which naturally contain levels of free fatty acids, and when lipolytic enzymes are components of the formulation. Lipolytic enzymes catalyse the degradation of fatty soils into free fatty acids and glycerol. Silicate is a common component of machine dishwashing formulations, where it is added for its china care capability. It is the Applicant's finding that by preventing the formation of calcium carbonate deposit "seeding centres", the build up of other deposit types from these "seeding centres" is also prevented.

SUMMARY OF THE INVENTION

There is provided a rinse aid composition containing an organo diphosphonic acid or its salts or complexes.

The pH of said composition as a 1% solution in distilled water at 20° C. is preferably less than 7.

DETAILED DESCRIPTION OF THE INVENTION

Organo diphosphonic acid crystal growth inhibitor

The first essential component of the compositions in accord with the invention is an organo diphosphonic acid or one of its salts or complexes. The organo diphosphonic acid component is preferably present at a level of from 0.005% to 20%, more preferably from 0.1% to 15%, most preferably from 0.5% to 10% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonic acid component may be present in its acid form or in the form of one of its salts or complexes with a suitable counter cation. Preferably any salts/complexes are water soluble, with the alkali metal and alkaline earth metal salts/complexes being especially preferred.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP).

pH of the compositions

In a highly preferred aspect of the invention the compositions have a pH as a 1% solution in distilled water at 20° C. of less than 7, preferably from 0.5 to 6.5, most preferably from 1.0 to 5.0.

The pH of the compositions may be adjusted by the use of various pH adjusting agents. Preferred acidification agents include inorganic and organic acids including, for example, carboxylate acids, such as citric and succinic acids, polycarboxylate acids, such as polyacrylic acid, and also acetic acid, boric acid, malonic acid, adipic acid, fumaric acid, lactic acid, glycolic acid, tartaric acid, tartronic acid, maleic acid, their derivatives and any mixtures of the foregoing. Bicarbonates, particularly sodium bicarbonate, are useful pH adjusting agents herein. A highly preferred acidification acid is citric acid which has the advantage of providing builder capacity to the wash solution.

Heavy metal ion sequestrants

Heavy metal ion sequestrants are useful components herein. By heavy metal ion sequestrants it is meant components which act to sequester (chelate) heavy metal ions. These components may also have calcium and magnesium chelation capacity, but preferentially they bind heavy metal ions such as iron, manganese and copper.

Heavy metal ion sequestrants are preferably present at a level of from 0.005% to 20%, more preferably from 0.1% to 10%, most preferably from 0.2% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate).

Other suitable heavy metal ion sequestrants for use herein include nitrilotriacetic acid and polyaminocarboxylic acids such as ethylenediaminotetracetic acid, ethylenetriamine pentacetic acid, or ethylenediamine disuccinic acid. Especially preferred is ethylenediamine-N,N'-disuccinic acid (EDDS), most preferably present in the form of its S,S isomer, which is preferred for its biodegradability profile.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

Low molecular weight acrylic acid containing organic polymer

The compositions in accord with the invention may contain as a preferred component an organic polymer containing acrylic acid or its salts having an average molecular weight of less than 15,000, hereinafter referred to as low molecular weight acrylic acid containing polymer. Such low molecular weight acrylic acid containing polymers may act as $CaCO_3$ dispersants, and thus further enhance the $CaCO_3$ deposition prevention capability of the compositions herein.

The low molecular weight acrylic acid containing polymer has, an average molecular weight of less than 15,000, preferably from 500 to 12,000, more preferably from 1,500 to 10,000, most preferably from 2,500 to 9,000.

The low molecular weight acrylic acid containing organic polymer is preferably present at a level of from 0.005% to 20%, more preferably from 0.1% to 10%, most preferably from 0.2% to 5% by weight of the compositions.

The low molecular weight acrylic acid containing polymer may be either a homopolymer or a copolymer including the essential acrylic acid or acrylic acid salt monomer units. Copolymers may include essentially any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof.

Preferred commercially available low molecular weight acrylic acid containing homopolymers include Sokalan PA30, PA20, PA15 and PA10 by BASF GmbH, and those sold under the tradename Acusol 45N by Rohm and Haas.

Preferred low molecular weight acrylic acid containing copolymers include those which contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen. The most preferred copolymer of this type has a molecular weight of 3500 and contains 60% to 80% by weight of acrylic acid and 40% to 20% by weight of methyl acrylic acid.

Preferred commercially available low molecular weight acrylic acid containing copolymers include those sold under the tradename Sokalan CP10 by BASF.

Other suitable polyacrylate/modified polyacrylate copolymers include those copolymers of unsaturated aliphatic carboxylic acids disclosed in U.S. Pat. Nos. 4,530,766, and 5,084,535 which have a molecular weight of less than 15,000 in accordance with the invention.

Additional organic polymeric compound

Certain additional organic polymeric compounds may be added to the rinse aid compositions of the invention, however, in certain cases their presence is desirably minimized. By additional organic polymeric compounds it is meant essentially any polymeric organic compounds commonly used as dispersants, anti-redeposition and soil suspension agents in detergent compositions, which do not fall within the definition of low molecular weight acrylic acid containing polymers given hereinbefore.

Additional organic polymeric compound may be incorporated into the rinse aid compositions of the invention at a level of from 0.05% to 30%, preferably from 0.5% to 15%, most preferably from 1% to 10% by weight of the compositions.

Examples of additional organic polymeric compounds whose presence is desirably minimized, and which are preferably not present, include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are the copolymers of polyacrylate with maleic anhydride having a molecular weight of from 20,000 to 150,000, especially about 40,000 to 80,000.

The polyamino compounds are useful herein including those derived from aspartic acid such as those disclosed in EP-A-305282, EP-A-305283 and EP-A-351629.

Other additional organic polymeric compounds suitable herein include cellulose derivatives such as methylcellulose, carboxymethylcellulose and hydroxyethylcellulose.

Further useful additional organic polymeric compounds are the polyethylene glycols, particularly those of molecular weight 1000–10000, more particularly 2000 to 8000 and most preferably about 4000.

Detergent Builder System

A highly preferred component of the rinsing compositions of the present invention is a detergent builder system which is preferably present at a level of from 0.5% to 60% by weight, more preferably from 1% to 30% by weight, most preferably from 2% to 20% weight of the composition.

The detergent builder system is preferably water-soluble, and preferably contains a carboxylate or polycarboxylate builder containing from one to four carboxy groups, particularly selected from monomeric polycarboxylates or their acid forms, homo or copolymeric polycarboxylic acids or their salts in which the polycarboxylic acid comprises at least two carboxylic radicals separated from each other by not more that two carbon atoms.

The detergent builder system can contain alkali metal, ammonium or alkanonammonium salts of bicarbonates, borates, phosphates, and mixtures of any of the foregoing.

Preferably, the detergent builder system contains no phosphate builder compound.

Carboxylate or polycarboxylate builder

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The carboxylate or polycarboxylate builder can be momomeric or oligomeric in type although monomeric polycarboxylates are generally preferred for reasons of cost and performance. Monomeric and oligomeric builders can be selected from acyclic, alicyclic, heterocyclic and aromatic carboxylates.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates, especially sodium citrate.

The parent acids of the monomeric or oligomeric polycarboxylate chelating agents or mixtures thereof with their salts, e.g. citric acid or citrate/citric acid mixtures are also contemplated as components of builder systems of the compositions in accordance with the present invention.

Phosphate builder compound

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid. Preferably, no phosphate builder compound is present.

Surfactant system

A highly preferred component of the compositions of the invention is a surfactant system comprising surfactant selected from anionic, cationic, nonionic, ampholytic and zwitterionic surfactants and mixtures thereof.

The surfactant system most preferably comprises low foaming nonionic surfactant, selected for its wetting ability, preferably selected from ethoxylated and/or propoxylated nonionic surfactants, more preferably selected from nonionic ethoxylated/propoxylated fatty alcohol surfactants.

When the surfactant system comprises low foaming nonionic surfactant the compositions preferably contain no additional suds suppressor components, such as silicone suds suppressors as can be found in certain machine dishwashing detergent compositions.

The surfactant system is typically present at a level of from 0.5% to 40% by weight, more preferably 1% to 30% by weight, most preferably from 5% to 20% by weight of the compositions.

Anionic surfactant

Essentially any anionic surfactants useful for detersive purposes can be included in the compositions. These can include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactant

Anionic sulfate surfactants suitable for use herein include the linear and branched primary alkyl sulfates, alkyl ethoxysulfates, fatty oleyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from about 0.5 to about 20 moles of ethylene oxide per molecule. More preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic sulfonate surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactant

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein.

Preferred alkyl ethoxy carboxylates for use herein include those with the fomula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–13 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3\ CH(R_4)$ COOM, wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$—$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $CH_3(CHR)_k$—$CH_2)_m$—$(CHR)_n$—CH(COOM)$(CHR)_o$—(CH2)$_p$—$(CHR)_q$—$CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Alkali metal sarcosinate surfactant

Other suitable anionic surfactants are the alkali metal sarcosinates of formula R—CON ($R^1$) $CH_2$ COOM, wherein R is $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Nonionic surfactant

Essentially any nonanionic surfactants useful for detersive purposes can be included in the compositions.

Exemplary, non-limiting classes of useful nonionic surfactants are listed below.

Nonionic polyhydroxy fatty acid amide surfactant

Polyhydroxy fatty acid amides suitable for use herein are those having the structural formula $R_2CONR_1Z$ wherein: $R_1$ is H, $C_1$–$C_4$ hydrocarbyl, 2-hydroxy ethyl, 2-hydroxy propyl, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

Nonionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic ethoxylated/propoxylated fatty alcohol surfactant

The ethoxylated $C_6$–$C_{18}$ fatty alcohols and $C_6$–$C_{18}$ mixed ethoxylated/propoxylated fatty alcohols are highly preferred surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO condensates with propylene glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO condensation products with propylene oxide/ethylene diamine adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Nonionic alkylpolysaccharide surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

Nonionic fatty acid amide surfactant

Fatty acid amide surfactants suitable for use herein are those having the formula:

$$R^6-\overset{\overset{\displaystyle O}{\|}}{C}-N(R^7)2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $-(C_2H_4O)_xH$, where x is in the range of from 1 to 3.

Amphoteric surfactant

Suitable amphoteric surfactants for use herein include the amine oxide surfactants and the alkyl amphocarboxylic acids.

A suitable example of an alkyl amphodicarboxylic acid for use herein is Miranol(TM) C2M Conc. manufactured by Miranol, Inc., Dayton, N.J.

Amine Oxide surfactant

Amine oxides useful in the present invention include those compounds having the formula:

$$R^3(OR^4)_xN(R^5)_2 \rightarrow O$$

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide.

Zwitterionic surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Betaine surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Sultaine surfactant

The sultaines useful herein are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Ampholytic surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched.

Cationic surfactants

Cationic surfactants can also be used in the compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Lime soap dispersant compound

The compositions of the invention may contain a lime soap dispersant compound, which has a lime soap dispersing power (LSDP), as defined hereinafter of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to , for example, in the following review articles; W. N. Linfield, Surfactant Science Series, Volume 7, p3; W. N. Linfield, Tenside Surf. Det. , Volume 27, pages159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025g of sodium oleate in 30 ml of water of 333 ppm $CaCO_3$ (Ca:Mg=3:2) equivalent hardness.

Polymeric lime soap dispersants suitable for use herein are described in the article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

Solvent

The compositions of the invention may contain organic solvents, particularly when formulated as liquids or gels. The compositions in accord with the invention preferably contain a solvent system present at levels of from 1% to 30% by weight, preferably from 3% to 25% by weight, more preferably form 5% to 20% by weight of the composition. The solvent system may be a mono, or mixed solvent system. Preferably, at least the major component of the solvent system is of low volatility.

Suitable organic solvent for use herein has the general formula $RO(CH_2C(Me)HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2 alkoxyethoxy) ethanol class wherein the alkoxy group is derived from ethyl, propyl or butyl; a preferred water-soluble carbitol is 2-(2-butoxyethoxy) ethanol also known as butyl carbitol. Water-soluble CELLOSOLVE solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The $C_1$–$C_4$ dihydric alcohols, including propylene glycol, are also preferred.

Hydrotropes

Hydrotrope may be added to the compositions in accord with the present invention, and is typically present at levels of from 0.5% to 20%, preferably from 1% to 10%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

Optional detergent components

Whilst the rinse aid compositions of the invention preferably contain optional detergent components selected from a detergent builder system, a surfactant system, a solvent, a hydrotrope, a pH adjusting agent and an organic polymeric compound, as described herein, they preferably do not contain cleaning components more typically found in machine dishwashing detergent compositions, such as bleaching species and enzymes.

Form of the compositions

The compositions of the invention can be formulated in any desirable form such as powders, granulates, pastes, liquids and gels. Liquid compositions are most preferred.

Liquid compositions

The compositions of the present invention are preferably formulated as liquid compositions which typically comprise from 94% to 35% by weight, preferably from 90% to 40% by weight, most preferably from 80% to 50% by weight of a liquid carrier, e.g., water, preferably a mixture of water and organic solvent.

Gel compositions

Gel compositions are typically formulated with polyakenyl polyether having a molecular weight of from about 750,000 to about 4,000,000.

Machine dishwashing method

The rinse aid compositions in accord with the present invention may be used in essntially any conventional machine dishwashing method of the conventional type performed using a dishwasher machine, which may be selected from any of those commonly available on the market.

The machine dishwashing method typically comprises treating soiled articles, such as crockery, glassware, hollowware and cutlery, with an aqueous liquid having dissolved or dispersed therein an effective amount of detergent composition. By an effective amount of detergent composition it is generally meant from 8 g to 60 g of detergent composition per wash, dissolved or dispersed in a wash solution volume of from 3 to 10 liters, as are typical product dosages employed in conventional machine dishwashing methods. The wash temperature may be in the range 40° C. to 65° C. as commonly is employed in such processes. The rinse aid composition is typically employed at levels of from 0.5g to 10g of rinse aid composition per rinse cycle.

Wash/rinse Solution

It has been found that calcium carbonate deposits are most likely to be a problem when certain threshold limits of both $Ca^{2+}/Mg^{2+}$ hardness and $CO_3^{2-}/HCO_3$— levels are exceeded in the wash/rinse solution. The compositions of the invention are hence most likely to be beneficial when used in rinse solutions in which said threshold limits have been exceeded.

In particular calcium carbonate deposit formation is likely to be a problem when the $CO_3^{2+}/HCO_3$— level in the rinse solution exceeds 8° German hardness, and when the $Ca^{2+}/Mg^{2+}$ level in the rinse solution exceeds 6° (3:1 Ca:Mg) German hardness (equivalent to 1.08 mmol $Ca^{2+}$/liter).

EXAMPLES

The following examples illustrate the present invention.

In the following compositions, the abbreviated identifications have the following meanings:

Citric : Citric acid

Nonionic: $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh.

HEDP : Ethane 1-hydroxy-1,1-diphosphonic acid

DETPMP : Diethylene triamine penta (methylene phosphonic acid), marketed by Monsanto under the tradename Dequest 2060

EDDS : Ethylenediamine-N, N'-disuccinic acid [S,S] isomer

AA/MA: Random copolymers of acrylic acid and methacrylic acid in a weight ratio of approximately 30:70, with a molecular weight of about 3,500

Polyacrylate: A polyacrylate homopolymer with an average molecular weight of 8,000 sold under the tradename PA30 by BASF GmbH SCS: Sodium cumene sulfonate Citrate: Trisodium citrate dihydrate MA/AA: Copolymers of 1:4 maleic/acrylic acid, average molecular weight about 80,000

Protease: Proteolytic enzyme sold under the trade name Savinase by Novo Industries A/S Amylase: Amylolytic enzyme sold under the trade name Termamyl by Novo Industries A/S Silicate: Sodium silicate (2.0 ratio)

PB1: Sodium perborate monohydrate

PB4: Sodium perborate tetrahydrate

TAED: Tetraacetyl/ethylene diamine

Paraffin: Paraffin oil, sold under the tradename Winog 70 by Wintershall

Example 1

The following liquid rinse aid compositions were prepared (parts by weight).

| | A | B | C | D | E | F |
|---|---|---|---|---|---|---|
| Citric | 6.5 | 6.5 | 6.5 | 6.5 | 6.5 | 6.5 |
| Nonionic | 12.0 | 12.0 | 12.0 | 12.0 | 12.0 | 12.0 |
| HEDP | — | 5.0 | 2.5 | 5.0 | 5.0 | 5.0 |
| DETPMP | — | — | 3.0 | — | — | — |
| EDDS | — | — | — | 3.0 | — | — |
| Polyacrylate | — | — | — | — | 5.0 | — |
| AA/MA | — | — | — | — | — | 5.0 |
| SCS | 4.8 | 4.8 | 4.8 | 4.8 | 4.8 | 4.8 |
| Ethanol | 6.0 | 6.0 | 6.0 | 6.0 | 6.0 | 6.0 |
| Ammonia | 0.7 | 0.7 | — | 0.7 | 0.7 | 0.7 |
| Water/misc to balance pH 1% solution | 3.3 | 3.3 | 2.4 | 3.3 | 3.3 | 3.3 |

Composition A is a prior art composition. Compositions B to F are in accord with the invention.

Calcium carbonate deposition evaluation

The tendency to form $CaCO_3$ deposits when used in a machine dishwashing/rinsing method of Composition B, which is in accord with the invention was compared to that of the prior art Composition A using the following test protocol:

A full set of dinnerware (12 dinner plates, 6 side plates, 12 saucers, 6 glasses, 8 tea cups, 16 stainless steel spoons, 4 silver spoons) was placed in a Bosch Siemens SMS 9022 (tradename) automatic dishwasher. 25g of detergent product (Composition I, formulation given below) was placed in the machine detergent dispenser, and 3 g of the test rinse aid product added to the rinse aid dispenser. The 65° C. cycle was selected. Subsequent to each admission of water, of known hardness, to the main cavity of the machine a volume of sodium bicarbonate was added to the water to provide a 30° German hardness level of carbonate/bicarbonate ions and 8° German harness levels (3:1 Ca:Mg) of $Ca^{2+}/Mg^{2+}$ ions (equivalent to 1.44 mmol $Ca^{2+}$/liter) in the wash/rinse solution. Subequent to the dispensing of the detergent to the wash solution 50 g of a representative liquid soil (comprising approximately 1.9% tomato ketchup, 1.9% mustard, 2% egg yolks, 39% milk, 0.6% benzoic acid, 1.9% (dissolved) gravy granules, 3.8% potato, water to balance) was added to the wash solution. This procedure was repeated until 8 complete machine cycles (each comprising prewash, wash, 2 rinses) had been completed (rinse aid is only added to the final rinse).

Results

After 8 complete cycles the machine was stopped and the machine parts and dinnerware were assessed for deposit formation using the following visual scale:

0=no deposits

1=slight deposits

2=significant/heavy deposits

The following results were obtained.

| | Composition | |
|---|---|---|
| Substrate | A | B |
| Glassware | 1 | 1 |
| Chinaware | 2 | 0 |
| Silverware | 2 | 1 |
| Stainless steel | 2 | 0 |
| Machine door | 2 | 0 |
| Machine heater element | 2 | 1 |
| Machine spray arm | 2 | 0 |

The MEDP containing formulation (composition B) is seen to give rise to only minor deposit formation. Composition A, by contrast gives rise to significant deposits.

| Detergent formulation employed in test protocol | |
|---|---|
| | I |
| Citrate | 29.0 |
| MA/AA | 3.7 |
| Silicate | 25.7 |
| PB1 | 1.9 |
| PB4 | 8.7 |
| TAED | 4.4 |
| Protease | 2.2 |
| Amylase | 1.5 |
| Benzotriazole | 0.3 |
| Paraffin | 0.5 |

-continued

| Detergent formulation employed in test protocol | |
|---|---|
| | I |
| Nonionic | 1.5 |
| DETPMP | 0.1 |
| Misc/moisture to balance | |
| pH (1% solution) | 10.7 |

We claim:

1. A rinse aid composition containing a non-nitrogen containing organo diphosphonic acid or a salt or complex thereof, at least 5% by weight of a surfactant system, and from 1% to 60% by weight of a carboxylate or polycarboxylate detergent builder selected from the group consisting of water soluble salts of lactic acid, glycolic acid and ethers thereof, succinic acid, malonic acid, (ethylenedioxy) diacetic acid, maleic acid, diglycolic acid, tartaric acid, tartronic acid, lamatic acid, citric acid, aconitic acid, and citraconic acid, the pH of said composition as a 1% solution in distilled water at 20° C. being less than 7.

2. A rinse aid composition according to claim 1, wherein the detergent builder is included in an amount of from 2% to 30% by weight.

3. A rinse aid composition according to claim 1, wherein the detergent builder is included in an amount of from 2% to 20% by weight.

4. A rinse aid composition according to claim 1 containing an organic polymer containing acrylic acid or its salts, having an average molecular weight of less than 15,000.

5. A rinse aid composition according to claim 4 wherein said organic polymer is a homopolymer having a molecular weight of from 500 to 12,000.

6. A rinse aid composition according to claim 4 wherein said organic polymer is present at a level of from 0.005% to 20% by weight of the composition.

7. A rinse aid composition according to claim 1 wherein said non-nitrogen containing organo diphosphonic acid is a $C_1$ to $C_4$ diphosphonic acid present at a level of from 0.005% to 20% by weight of the composition.

8. A rinse aid composition according to claim 7 wherein said non-nitrogen containing organo diphosphonic acid is ethane-1-hydroxy-1,1 diphosphonic acid present at a level of from 0.1% to 15% by weight of the composition.

9. A rinse aid composition according to claim 1 containing from 0.005% to 20% by weight of a heavy metal ion sequestrant comprising at least one organo aminophosphonate, nitrilotriacetic acid, polyaminocarboxylic acid or iminodiacetic acid derivative.

10. A rinse aid composition according to claim 1 containing from 5% to 40% by weight of the surfactant system.

11. A rinse aid composition according to claim 1, wherein the pH of said composition as a 1% solution in distilled water at 20° C. is from 0.5 to 6.5.

12. A rinse aid composition according to claim 1, wherein the pH of said composition as a 1% solution in distilled water at 20° C. is from 1.0 to 5.0.

13. A rinse aid composition according to claim 1, wherein the surfactant system comprises at least one surfactant selected from the group consisting of anionic, cationic, nonionic, ampholytic and zwitterionic surfactants, and mixtures thereof.

14. A rinse aid composition containing a non-nitrogen containing organo diphosphonic acid or a salt or complex thereof, a surfactant system comprising at least one nonionic surfactant, and from 2% to 60% by weight of a carboxylate or polycarboxylate detergent builder selected from the group consisting of water soluble salts of lactic acid, glycolic acid and ethers thereof, succinic acid, malonic acid, (ethylenedioxy) diacetic acid, maleic acid, diglycolic acid, tartaric acid, tartronic acid, fumaric acid, citric acid, aconitic acid, and citraconic acid, the pH of said composition as a 1% solution in distilled water at 20° C. being less than 7.

15. A rinse aid composition according to claim 14, wherein the detergent builder is included in an amount of from 2% to 30% by weight.

16. A rinse aid composition according to claim 14, wherein the detergent builder is included in an amount of from 2% to 20% by weight.

17. A rinse aid composition according to claim 14 containing an organic polymer containing acrylic acid or its salts, having an average molecular weight of less than 15,000.

18. A rinse aid composition according to claim 17 wherein said organic polymer is a homopolymer having a molecular weight of from 500 to 12,000.

19. A rinse aid composition according to claim 17 wherein said organic polymer is present at a level of from 0.005% to 20% by weight of the composition.

20. A rinse aid composition according to claim 14 wherein said non-nitrogen containing organo diphosphonic acid is a $C_1$ to $C_4$ diphosphonic acid present at a level of from 0.005% to 20% by weight of the composition.

21. A rinse aid composition according to claim 20 wherein said non-nitrogen containing organo diphosphonic acid is ethane-1-hydroxy-1,1 diphosphonic acid present at a level of from 0.1% to 15% by weight of the composition.

22. A rinse aid composition according to claim 14, wherein the surfactant system comprises at least one nonionic surfactant selected from the group consisting of ethoxylated and propoxylated nonionic surfactants.

23. A rinse aid composition according to claim 14, wherein the surfactant system is included in the composition in an amount of from 1% to 30% by weight.

24. A rinse aid composition according to claim 14, wherein the surfactant system is included in the composition in an mount of from 5% to 20% by weight.

25. A rinse aid composition according to claim 14 containing from 0.005% to 20% by weight of a heavy metal ion sequestrant comprising at least one organo aminophosphonate, nitrilotriacetic acid, polyaminocarboxylic acid or iminodiacetic acid derivative.

26. A rinse aid composition according to claim 14 containing from 0.5% to 40% by weight of the surfactant system.

* * * * *